United States Patent [19]

Okada

[11] Patent Number: 4,534,560

[45] Date of Patent: Aug. 13, 1985

[54] SLOT MACHINE

[75] Inventor: Kazuo Okada, Tokyo, Japan

[73] Assignee: Kabushiki Kaisha Universal, Tochigi, Japan

[21] Appl. No.: 496,578

[22] Filed: May 20, 1983

[30] Foreign Application Priority Data

May 21, 1982 [JP] Japan ..... 57-85039

[51] Int. Cl.[3] ..... A63F 5/04

[52] U.S. Cl. ..... 273/143 R

[58] Field of Search ..... 273/143 R, 143 B, 143 C, 273/143 D

[56] References Cited

U.S. PATENT DOCUMENTS 4,095,795 6/1978 Saxton et al. ..... 273/143 R 4,138,114 2/1979 Anderson ..... 273/143 R

FOREIGN PATENT DOCUMENTS 2054232 7/1979 United Kingdom ..... 273/143 R

*Primary Examiner*—Richard C. Pinkham

*Assistant Examiner*—Vincent A. Mosconi

*Attorney, Agent, or Firm*—Young & Thompson

[57] ABSTRACT

A slot machine has a plurality of reels, each having an annular series of various symbols on the periphery thereof and having, on a side thereof, a plurality of light shield plates different in shape from each other for distinguishing regions into which the reel is divided. Pulse signals for causing a pulse motor to rotate by an angle corresponding to each region are counted. A position of the reel either in rotation or stopped is determined based on the number of counted pulse signals and the region as distinguished by the detection of the shape of the associated light shield plate.

6 Claims, 5 Drawing Figures

SLOT MACHINE

BACKGROUND OF THE INVENTION

The present invention relates to a slot machine of the type having a plurality of reels each having an annular series of spaced symbols on the peripheral surface thereof and, more particularly, to a slot machine in which the position of a reel either in rotation or at rest is determined according to regions into which the reel is divided and the number of pulse signals supplied to a pulse motor associated with the reel during rotation of the reel.

In recent slot machines, each reel is rotated by a pulse motor which is controlled by pulse signals provided by a microcomputer. The slot machine, which pays out tokens or coins according to predetermined prize-winning combinations of symbols on the reels in stopped position occurring on a specific line, is required to determine what combination of symbols has occurred on the specific line. In such slot machines having pulse motors as disclosed in, for instance, U.S. patent application Ser. No. 338,497, each reel is provided with a light shield plate which acts to reset the previous content of a pulse signal counting means to an initial content every time the light shield plate passes through a photo-detecting device at a fixed position in order to prevent the pulse motor from rotating without syncronism. Since the information of a certain relation between the symbols on each reel and the number of pulse signals is stored in a table memory, a symbol on a reel in stopped position is determined by reading the table memory while using the content of pulse signal counting means as an address signal.

As a reference point on a reel, in conventional slot machines, is detected by the use of a single light shield plate provided on the reel, the reel cannot be brought to a stop unless the light shield plate is detected. For this reason, a lamp is provided, which turns on after the detection of light shield plate at a fixed position, to indicate that a micro-computer is ready for receiving an instruction signal for stopping the reel from a push button switch. This procedure is time consuming, resulting in a prolonged duration for a game and hence in a reduction in the working ratio of the machine. Moreover, asynchronism of the pulse motor, if it occurs, can not be eliminated until the pulse motor has caused the reel to rotate fully one revolution, thus give rise to a difference between the counter-indicated and the actual stopped position of the reel.

SUMMARY OF THE INVENTION

It is accordingly an important object of the present invention to provide a slot machine wherein an operation for stopping the reels is possible after only a very short period of time.

It is another object of the present invention to provide a slot machine wherein asynchronism of pulse motor, if it occurs can be eliminated in a much shorter time, thereby ensuring no difference between the counter-indicated and the actual stopped position of a reel.

The foregoing and other objects of the present invention are achieved by providing a plurality of light shield plates with shapes different from each other on every reel, which divide the reel into a plurality of regions. The respective light shield plates are detected by a photo-detecting device so as to detect which region is opposite to a specific point on a stationary part of the slot machine. The position of the reel, either in rotation or at rest, opposite to the specified point is determined according to a detected region and the number of pulse signals which have been supplied to the pulse motor to rotate the reel within the detected region. Since pulse signals are counted every region, time consumption before the operation for stopping the reel is shortened to one quarter if the reel is divided into four regions. Furthermore, since the pulse counting means is reset to its initial content every time a light shield plate is detected asynchronism of the pulse motor, if it occurs, is eliminated in a short time.

BRIEF DESCRIPTION OF THE DRAWINGS

Other objects and features of the present invention will become apparent to those skilled in the art from a consideration of the following description, taken in conjunction with the accompanying drawings, in which.

DETAILED DESCRIPTION OF THE INVENTION

Figure 1:
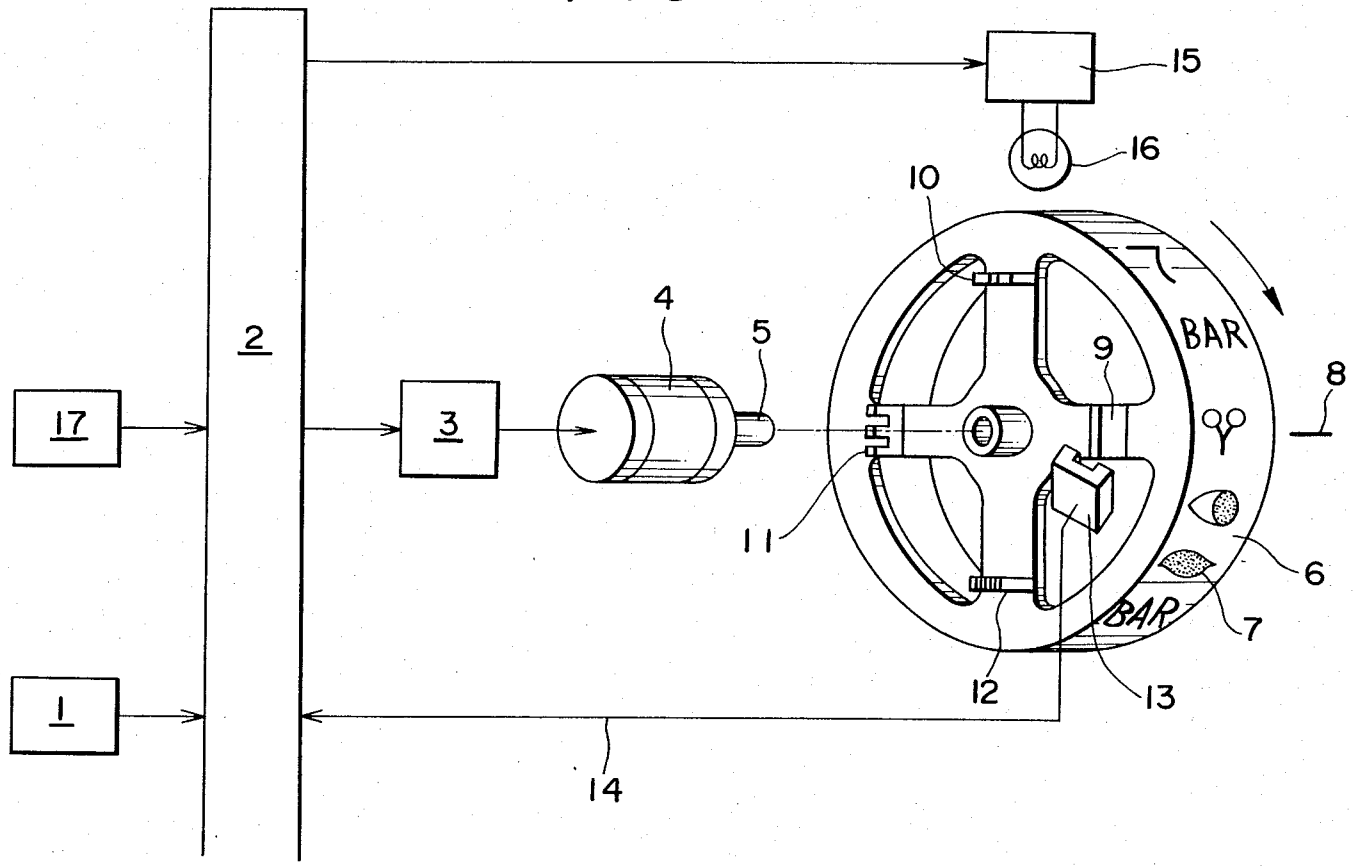
FIG. 1 is a perspective view of an apparatus according to the present invention.

Because slot machines are well known, this description is directed in particular to elements forming part of or cooperating directly with the preferred embodiment. It is to be understood, however, that other elements not shown or described may take various forms known or obvious to one having ordinary skill in the design of slot machines. In the drawings there is shown a single reel for simplicity, however a plurality of reels, for instance three reels, are provided in practice.

Referring now to FIG. 1 showing a preferred embodiment of the present invention, there is shown a reel which has an annular series of various symbols printed or otherwise provided on the peripheral surface thereof at regular intervals. Upon pushing a button switch 1 for initiating a game, a start signal is produced and supplied to a microcomputer 2, and causes it to provide, under the control of a pulse generating program, pulse signals which are supplied to a driving circuit 3 for driving a pulse motor 4. Provided on a shaft 5 of the pulse motor 4 is a reel 6 having an annular series of various symbols on the peripheral surface thereof at regular intervals. When the slot machine detects a predetermined prize-winning combination of symbols on the reels in the stopped position, it causes the payout of different numbers of tokens or coins according to the displayed combinations.

Figure 2:
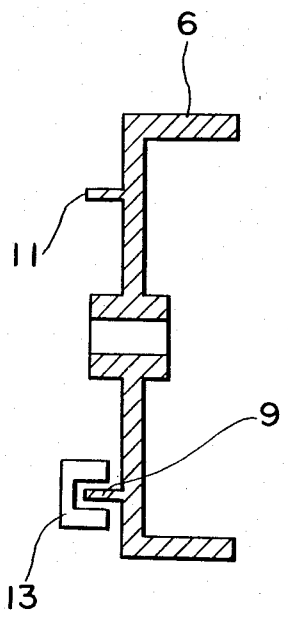
FIG. 2 is a cross sectional view of an essential part in the apparatus of FIG. 1.

On a side of the reel 6 light shield plates 9 to 12 with shapes different from each other are provided at regular intervals. The light shield plates 9 to 12 can be detected by a photodetecting device 13 shown in FIG. 2 which provides output signals and supplies them to the microcomputer 2. At the time when the photo-detecting device 13 detects any one of the light shield plates 9 to 12, a lamp 16 is lighted to give an instruction to a player that he is allowed to push a button switch 17 for bringing the reel to a stop. The microcomputer 2 resets a counting means therein, which counts pulse signals supplied to the driving circuit 3, to an initial content every time the photo-detecting device 13 detects each of light shield plates 9 to 12. It is to be noticed that pulse signals to the driving circuit 3 are counted for each divided region shown in FIG. 3. Consequently, the stopped position of the reel 6 is determined according to a divided region and the number of pulse signals counted until then. Since a certain relation between the stopped positions of reel and the symbols thereon has been previously stored in a table memory of the microcomputer 2, a combination of symbols on reels which has occurred on a prize-winning line 8 is determined according to that relation.

Figure 3:
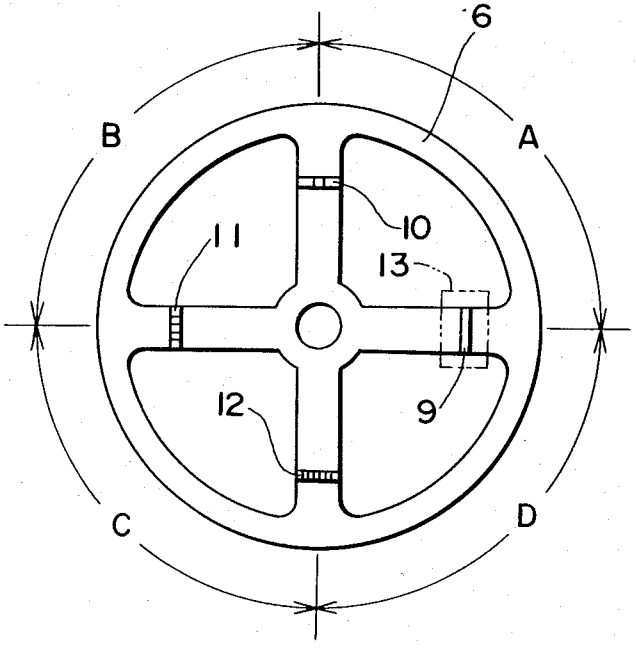
FIG. 3 is a plan view of a reel.

FIG. 3 shows the relation between the light shield plates 9 to 12 arranged at equal angles and regions A to D each defined between the light shield plates adjacent to each other. It is to be understood that a different number of light shield plates may be arranged at either regular or different angles.

Figure 4:
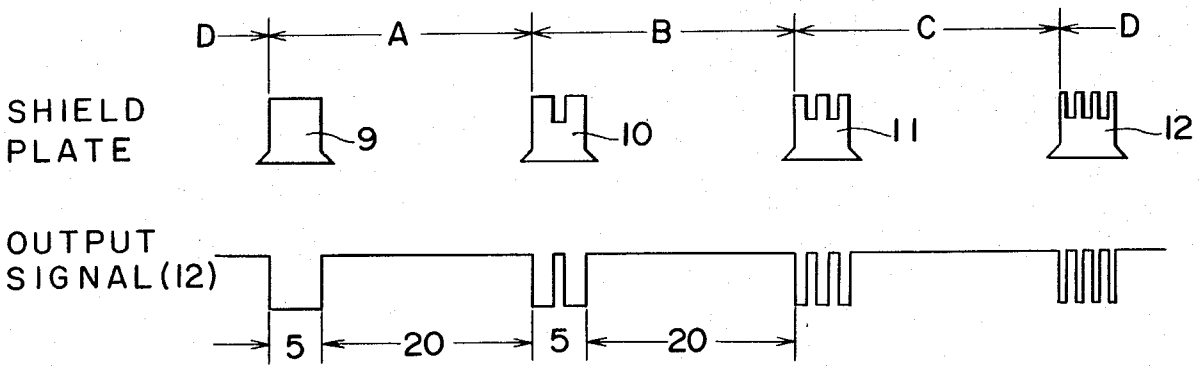
FIG. 4 is a timing chart showing the relationship between the light shield plates and the output wave forms from a photo-detecting device.

FIG. 4 shows an embodiment of the relation between the light shield plates and the output signals from the photo-detecting device. The photo-detecting device 13, in this embodiment, produces a series of output signals having the wave forms shown in the chart every time the light shield plates 9 to 12 pass therethrough, it being possible to determine the divided regions from the wave forms. The reel is rotated by the angle made by each region every time 25 pulse signals are supplied to the pulse motor driving circuit 3. In this embodiment each light shield plate has a width equivalent to five pulse signals, and the interval at which symbols are arranged also corresponds to the width for five pulse signals. Pulse signals from the photo-detecting device 13 during said five pulse signals produced are counted by the pulse counting means to determine which light shield plate, and hence which divided region is detected. It is, here, to be noted that the content of the pulse counting means is reset to an initial state by the trailing edge of the previous signal which is generated by an interruption of the photo-detecting device 13 by each light shield plate.

Figure 5:
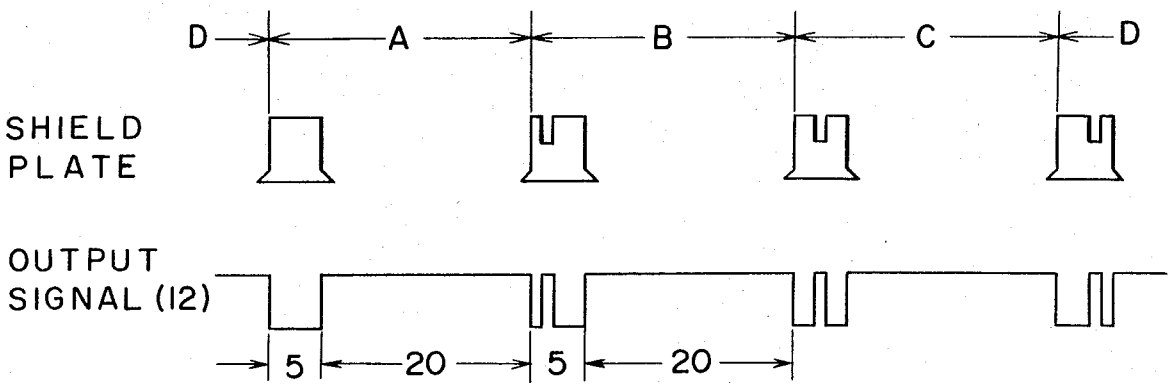
FIG. 5 is a timing chart similar to that of FIG. 4 in another embodiment of the present invention.

In another embodiment of the present invention shown in FIG. 5, there are shown light shield plates with a notch at different positions which can indicate the respective regions. That is, different periods of time between the trailing edge of the previous signal and the leading edge of the first produced pulse signal for each light shield plate correspond to the individual divided regions. It is apparent from this embodiment that different widths of light shield plates may be employed.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A slot machine provided with a plurality of pulse motor driven reels each having an annular series of various symbols on the peripheral surface thereof at regular intervals, said slot machine comprising:

a plurality of light shield plates for dividing said peripheral surface of each reel into a plurality of regions each containing a plurality of said symbols, said light shield plates being different in shape from each other and being arranged at concyclic positions and at the front edges of said respective divided regions so as to distinguish the respective divided regions;

photo-detecting means for every reel stationarily provided in a passageway of said light shield plates for producing a series of pulse signals with different wave forms one corresponding to the shape of each said light shield plate passing therethrough;

a microcomputer for counting the number of pulse signals which cause each pulse motor to rotate by an angle corresponding to said respective region and for detecting a position of said each reel in rotation according to said counted number of pulse signals and said pulse signals whose wave forms correspond to respective said regions.

2. A slot machine as defined in claim 1, said light shield plates having different numbers of notches.

3. A slot machine as defined in claim 2, said light shield plates being provided on a side of each reel.

4. A slot machine as defined in claim 3, said light shield plates being provided at four points at regular intervals.

5. A slot machine as defined in claim 4, each of said light shield plates having a width equivalent to five said pulse signals.

6. A slot machine as defined in claim 1, said light shield plates having the same number of notches at different positions.

* * * * *